United States Patent [19]

Luberacki

[11] Patent Number: 4,563,029

[45] Date of Patent: Jan. 7, 1986

[54] MATCH HOLDER

[75] Inventor: Louis L. Luberacki, Minneapolis, Minn.

[73] Assignee: Louis Joseph Luberacki, Minneapolis, Minn.

[21] Appl. No.: 493,679

[22] Filed: May 11, 1983

[51] Int. Cl.[4] ..... B25J 1/04; F23Q 25/00

[52] U.S. Cl. ..... 294/19.1; 431/269

[58] Field of Search ..... 294/19 R, 1 R, 9, 22, 294/26.5, 34, 50, 50.5, 50.6, 50.7, 50.8, 50.9, 100, 99; 431/269, 144, 344, 345

[56] References Cited

U.S. PATENT DOCUMENTS 3,990,735 11/1976 Starz ..... 294/1 R

*Primary Examiner*—James B. Marbert

*Attorney, Agent, or Firm*—Kinney & Lange

[57] ABSTRACT

A match holder provides an extension to a stick match so that a fire can be lit in combustion equipment having a relatively inaccessible combustion chamber such as in a wood burning stove, oil stove or water heater. The match holder includes an elongated member, preferably made of wood, having a handle section proximate one end and a bore at another end. The bore is adapted for receiving an end portion of the stick match and for frictionally holding the match while the fire is being lit. A match ejector is positioned within a slot that is disposed behind the bore and communicates with the bore. The ejector is slidable between an ejecting position and a non-ejecting position within the slot. In the ejecting position, the ejector extends into the bore to engage the end of the match and eject the match from the bore. Tabs for manual movement of the ejector are fixedly attached to the ejector and extend outwardly from the slot.

14 Claims, 4 Drawing Figures

MATCH HOLDER

BACKGROUND OF THE INVENTION

1. Field of the Invention

The present invention relates to match holders. In particular, it relates to a match holder that holds a match, permitting lighting of a fire in an inaccessible place and allows the user to manually eject the match from the match holder without touching the match.

2. Description of the Prior Art

Combustion equipment, such as fireplaces, wood burning stoves and furnaces, oil stoves, and water heaters, are typically lit by using a match. The location of the combustion area is often times hard to reach. For example, a pilot light in a gas water heater is generally accessible only through a small opening and positioned a sufficient distance from the opening so that lighting the pilot light is difficult. A similar situation often time exists in lighting pilot lights in gas furnaces. Oil burning stoves also have a combustion chamber that is difficult to reach. In addition, many types of oil stoves have a combustion chamber that is lit from the top which presents a slight danger of burning the hand that is holding the match. Wood burning stoves and furnaces and fireplaces have more accessible combustion chambers, however, the combustion chambers are typically very dirty from soot. In trying to light a fire with a standard match in such combustion chambers, the lighter's hands often times become dirty from the soot.

There are commercially-available long stick matches which permit the user to reach a relatively inaccessible combustion chamber or pilot light. However, these matches are typically four to five times as expensive as common wooden stick matches.

Several types of match holdes are described in several U.S. patents. In the Wilder U.S. Pat. No. 407,883, a match holder is shown made of a heavy wire coiled to form a rigid tapered socket. The match is wedged into the tapered end of the socket. However, the coiled wire socket of the Wilder Patent requires that the user grasp the portion of the match that has not been burned to avoid the sooty burned portion and manually remove the match by twisting the match out of the socket. Furthermore, if the match has been substantially burned, the user does not have an end of the match to grasp to remove the unburned portion of the match from the socket.

The Stegner U.S. Pat. No. 2,822,204 also shows a match holder having a coiled wire holder. To eject the match from the coiled holder in the Stegner Patent, another match or object is pushed into an opening at the rear of the coiled wire holder to push the burned match out of the holder.

The Williams U.S. Pat. No. 2,786,928 and the Porter U.S. Pat. No. 2,601,455 show match holders that hold a match between resilient wire clamps. However, these types of match holders are relatively expensive to manufacture.

The Gibson et al U.S. Pat. No. 3,781,051 describes a match holder that is made of a single sheet of spring steel which has been curved to a split tubular shape. The spring steel holder is attached to an extension rod so that the lighted match can be positioned in an accessible location. The match is wedged in the wider end of the holder. However, no provision is made to easily eject the match from the holder.

SUMMARY OF THE INVENTION

The present invention includes a match holder for holding a match an extended distance from the hand of a person lighting a fire so that a fire can be lit in a hard to reach or relatively inaccessible location. The match holder includes an elongated member, preferably made of wood, and having an extension handle section proximate a first end and a bore having an opening at a second end and extending inwardly into the elongated member along a second end portion. The bore is adapted to receive an end portion of a match, such as a standard stick match, and to frictionally hold the match while the match is being used to light a fire. The holder includes an ejector manually operated to eject the match from the end of the bore. The ejector is slidably movable between an ejecting position and a non-ejecting position along a slot located in the elongated member communicating with the bore. The ejector extends from the slot into the bore and engages the end of the match to eject the match from the bore. The slot preferably extends to the outer surface on opposite sides of the elongated member. A pair of tabs fixedly attached to the ejector extend outwardly from the slot permitting the user to move the ejector from a non-ejecting position to an ejecting position without having to touch the burned match.

DETAILED DESCRIPTION OF THE PREFERRED EMBODIMENTS

Figure 1:
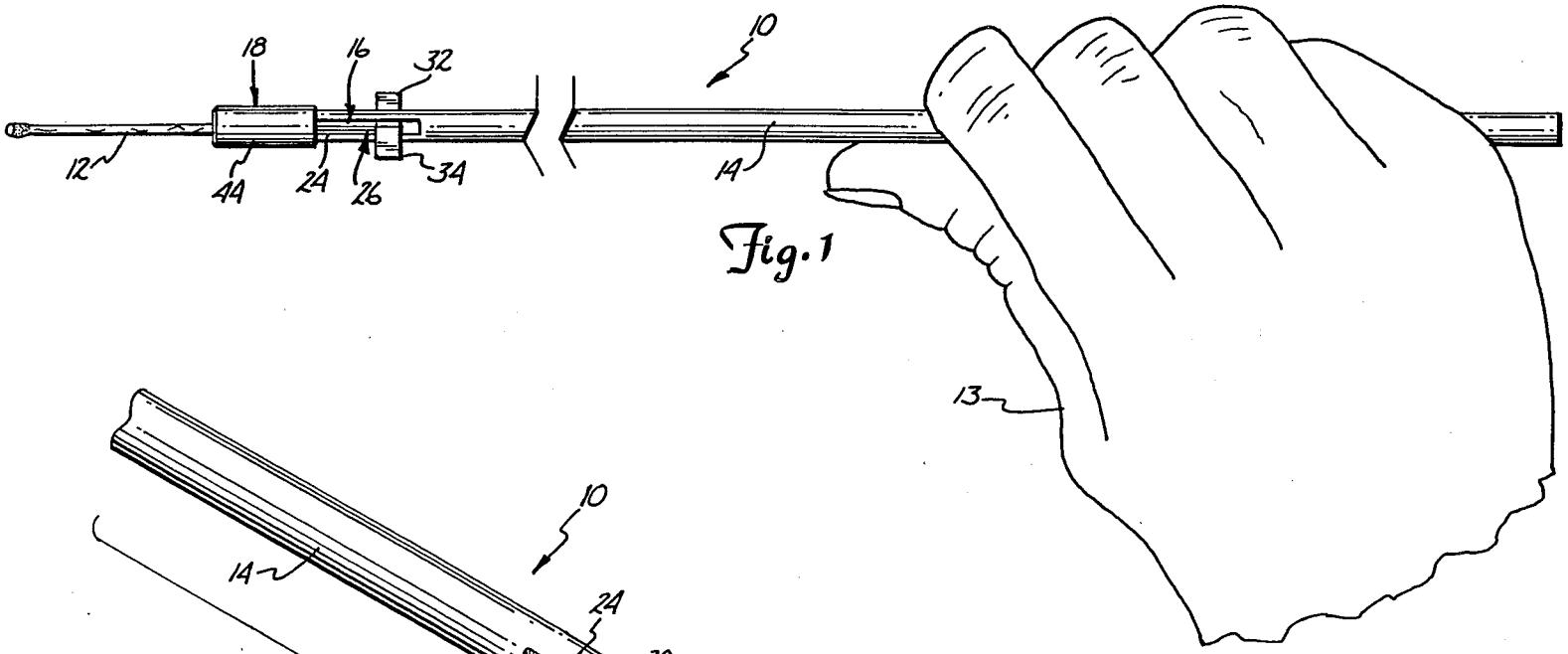
FIG. 1 is a perspective view of the present invention.

A match holder of the present invention is generally indicated at 10 in FIG. 1. The match holder 10 permits a user to hold a lighted wood stick match 12 with a hand 13 an extended distance from the match 12 so that a fire can be lit in a relatively inaccessible combustion area such as is found in an oil stove, wood burning stove, water heater and other similar type of combustion equipment. The match holder 10 allows the stick match 12 to burn along its entirety or until the fire is lit. The user then can eject the match 12 from the match holder 10 without touching the match 12. The match holder 10 includes a longitudinal extension handle section 14, an ejector mechanism 16 and a match holding section 18.

The extension handle section 14 is preferably made of wood, however, it can be made of any other type of suitably rigid material. The important feature of the handle section is that it is sufficiently long to allow the user to reach a relatively inaccessible combustion chamber. In one successful embodiment of the present invention, the handle section is approximately ten and one-half ($10\frac{1}{2}$) inches long and the entire match holding device including the ejector mechanism 16 and match holding section 18 is twelve (12) inches long. It has been found that this length provides a sufficient extension permit the user to light a fire in an inaccessible combustion chamber.

Figure 3:
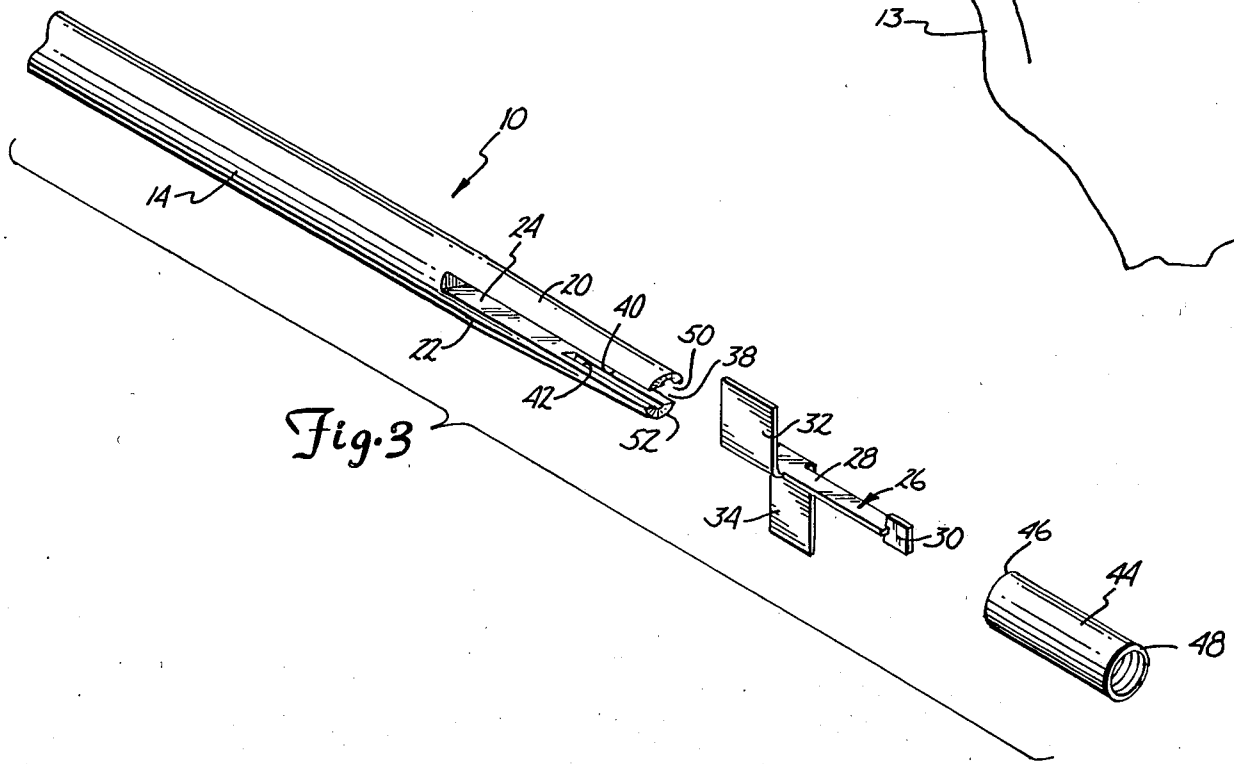
FIG. 3 is an exploded perspective view of the match retaining and ejecting mechanisms.

The match ejection mechanism 16 is best illustrated in FIG. 3. The ejector mechanism 16 includes first and second resilient members 20 and 22, which are preferably integral with the handle section 14. The upper and lower resilient members are spaced from each other to define a slot 24. An ejector 26, constructed of a rigid material such as metal, is operatively disposed within the slot 24.

The ejector 26, as best seen in FIG. 3, includes a substantially flat main portion 28, a forward match engaging portion 30, and a pair of ejector tabs 32 and 34, all preferably integral with each other.

Figure 2:
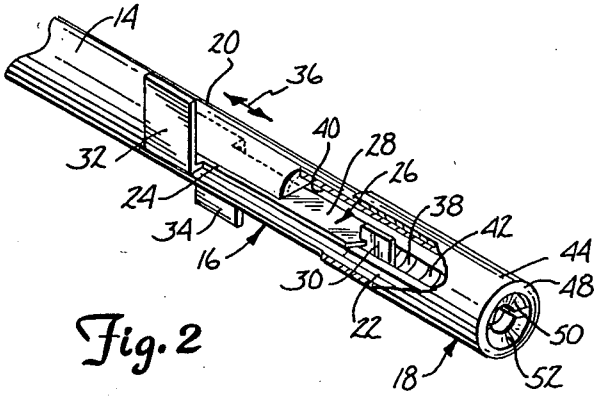
FIG. 2 is a perspective view of the match retaining and ejecting mechanisms.

As illustrated in FIGS. 2 and 3, the substantially flat main portion 28 of the ejector 26 slides operably along an axis of the device within the slot 24 as indicated by arrow 36. The tabs 32 and 34 extend outwardly from opposite sides of the slot 24 and are disposed angularly from the plane of the slot. Preferably, the tabs 32 and 34 are disposed angularly to the plane of the slot 24 and in opposite directions. A plane of the forward portion 30 of the ejector 26 is disposed substantially perpendicularly to the plane of the flat main portion 28 and is positioned within a bore 38 defined by a first inner cylindrical surface 40 of the first resilient member 20 and a second inner cylindrical surface 42 of the second resilient member 22. The perpendicular disposition of the forward portion 30 and the angular disposition of the tabs 32 and 34 retain the ejector 26 within the slot 24 and the bore 38.

The match holding section 18 includes a metal cylindrical ferrule 44 and the bore 38 defined by the first and second cylindrical surfaces 40 and 42. The resilient members 20 and 22 have slightly tapered outer surfaces, tapering toward the ends of the resilient members, as best illustrated in FIG. 3, which are surrounded by the ferrule 44. A rearward end portion 46 of the ferrule 44 engages the resilient members 20 and 22 slightly forcing the resilient members towards each other to frictionally hold the match. The ferrule 44 is fixedly attached to the outer surface of the resilient members 20 and 22 by crimping the rearward end portion 46 or through any other suitable method. The slightly tapered outer surfaces of the resilient members are spaced slightly from the inner surface of the forward section of the ferrule 44 permitting the members 20 and 22 to resiliently move when a stick match is inserted into the bore 38. The bore has a diameter approximately equal to the thickness of a stick match. It has been found that the bore 38 when produced by a Number 30 drill results in the first and second cylindrical surfaces 40 and 42 satisfactorily holding the match 12.

The bore 38 is of a sufficient depth to hold a stick match 12 securely. In one successful embodient, the depth of bore 38 is approximately three-quarters ($\frac{3}{4}$) of an inch with approximately one-half ($\frac{1}{2}$) inch of the depth of the bore 38 available for holding the stick match 12 with approximately one-quarter ($\frac{1}{4}$) inch being occupied by the forward section 30 of the ejector 26.

The ferrule 44 preferably has a forward end portion 48 with an inwardly bent edge for protecting the resilient members from the match flame when the stick match 12 is permitted to burn its entire length.

The resilient members 20 and 22 preferably have inner end surface portions 50 and 52 that are outwardly tapered. The outwardly tapered end portions 50 and 52 facilitate the insertion of a match between the resilient members 20 and 22.

In use, a standard-type stick match 12 is inserted within the end of the bore 38 with the ejector in a rearward position, as illustrated in FIG. 1. The resilient members 20 and 22 move outwardly and resiliently hold the match 12. The match holder 10 holds the match 12 sufficiently securely so that the match 12 can be struck while in the holder.

The match holder 10 provides the user with an extension so that inaccessible or hard to reach combustion chambers such as are found in oil stoves, water heaters or the like, can now easily be lit with the present invention. The match 12 can be permitted to burn its entire length, providing the user with extra time in trying to light the combustion chamber, if the combustion chamber proves difficult to light.

Figure 4:
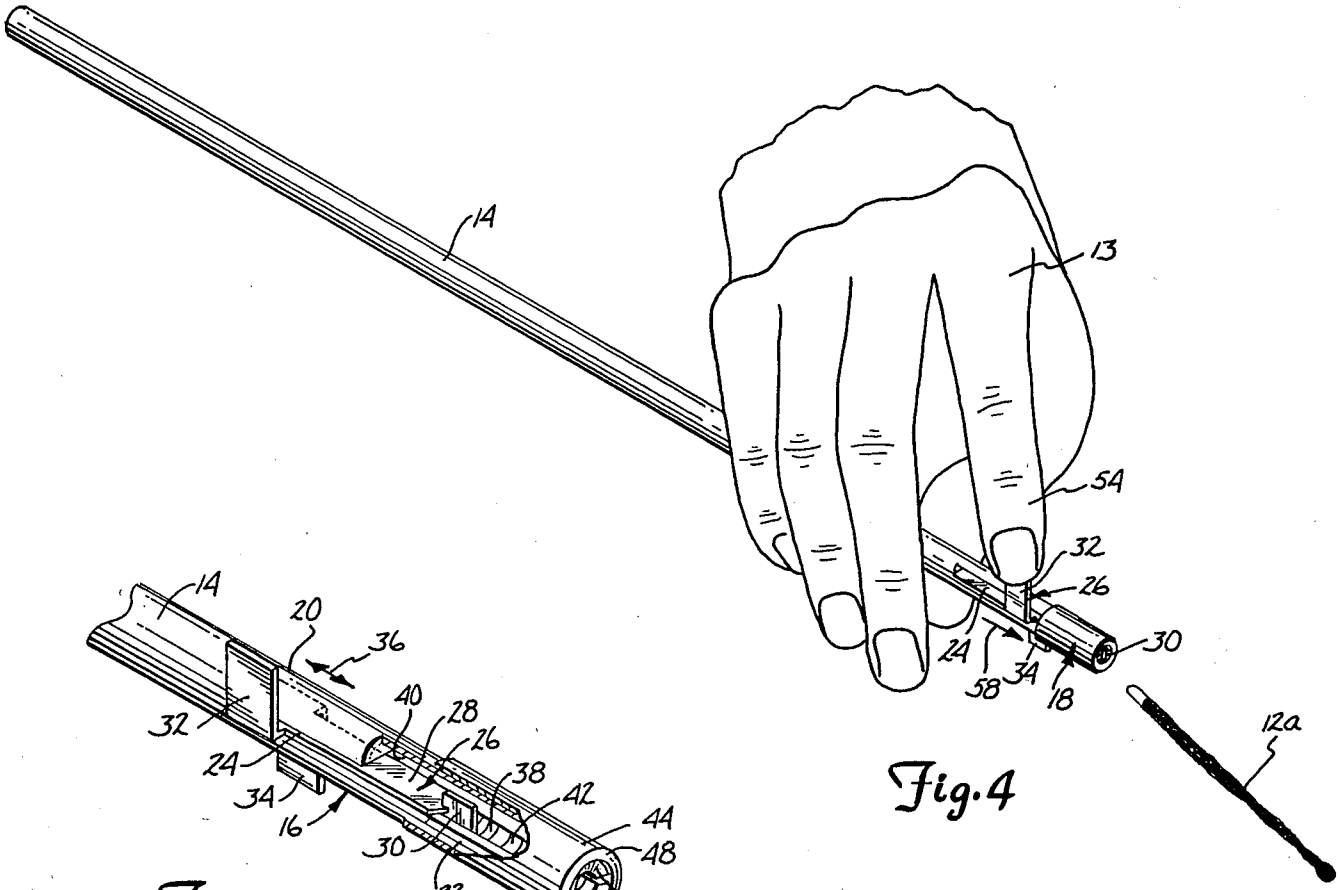
FIG. 4 is a perspective view illustrating the manner of ejecting a match from the match holding device of the present invention.

After the combustion chamber has been lit and the match extinguished, the burned match **12*a* is simply ejected from the match holding device, as illustrated in FIG. 4. Either one of the tabs 32 or 34 are engaged by a finger 54 of hand 13 and are pushed in a longitudinal direction, as indicated by arrow 58. The tabs 32 or 34 slide the ejector 26 along the slot 24 to eject the match 12. The tabs 32 and 34 extend sufficiently outwardly from the slot 24 so that they are easily engaged by the hand 13. The forward end 30 of the ejector 26 is disposed proximate the forward end of the resilient members 20 and 22 when the ejector 26 is in the forward position. The ferrule 44 acts as a stop and defines the forward position of the ejector 26**.

Although the present invention has been described with reference to preferred embodiments, workers skilled in the art will recognize that changes may be made in form and detail without departing from the spirit and scope of the invention.

What is claimed is:

1. A match holder for holding a match while the match is lit, the holder comprising:

an elongated member having first and second ends;

match retaining means for frictionally holding the match within a bore positioned proximate the second end, the match retaining means including spaced first and second resilient members connected to the elongated member defining a slot therebetween and having first and second inner surfaces, respectively, defining the bore and resiliently clamping the match so that the match is frictionally held by the resilient members;

an ejector having a first section positioned and slidable within the slot and having a second section connected to the first section having a match engaging end, the second section being movable within through the bore to engage and eject the match when the ejector is moved from a non-ejecting position to an ejecting position; and means for moving the ejector from the non-ejecting to the ejecting position to eject the match from the match retaining means.

2. The holder of claim 1 wherein the second section is disposed approximately 90° with respect to the first section.

3. The holder of claim 1 wherein the ejector has a first tab attached to the first section, the tab extending from the slot for manual engagement so that the ejector is movable between the ejecting and non-ejecting positions.

4. The holder of claim 1 wherein the handle section is made of wood.

5. The holder of claim 1 wherein the resilient members have exterior tapered surfaces tapering toward the second end and further including a ferrule encompassing a portion of the resilient members and having a rearward end fixedly attached to the resilient members at a rearward portion, the resilient members being slightly spaced from the ferrule at the tapered surfaces to permit resilient outward movement of the resilient members.

6. The holder of claim 5 wherein the ferrule is made of metal.

7. The holder of claim 6 wherein the bore has a diameter approximately equal to the thickness of a standard stick match.

8. The holder of claim 1 wherein the end of the bore has an outwardly tapered surface to facilitate placement of the end portion of the match within the bore.

9. The holder of claim 3 wherein the slot communicates with the exterior surface of the elongated member on opposite sides and the ejector has a second tab attached to the first section on a side opposite from the first tab, the second tab extending from the slot for manual engagement.

10. The holder of claim 9 wherein the first and second tabs are angularly disposed with respect to a plane of the slot in opposite directions.

11. The holder of claim 10 wherein the first and second rigid sections and the tabs are an integral unit.

12. The holder of claim 10 wherein the first and second rigid sections and the first and second tabs are made of metal.

13. A match holder for holding a match, the holder comprising:

an elongated wooden member having first and second ends with a handle section proximate the first end and first and second resilient fingers proximate the second end defined by a slot extending from the second end a predetermined distance into the elongated member, the resilient fingers having a slightly tapered outer surface, tapering toward the second end and having inner surfaces defining a bore disposed along a plane common with the slot and extending from the second end into the elongated member a distance less than the slot;

an ejector made of a material having a rigid main flat portion movable within the slot and into the bore, a forward section attached to the main portion disposed within the bore and first and second tabs extending from the main portion and the slot for manual engagement; and a ferrule having first and second ends, the first end fixedly attached to the slightly tapered outer surfaces of the resilient fingers providing a force to the fingers so that the fingers flex toward each other.

14. The holder of claim 13 wherein the bore at the second end of the elongated member has an outwardly tapered surface for facilitating placement of an end portion of the match within the bore.

* * * * *